United States Patent [19]

Bachhuber et al.

[11] 4,133,249

[45] Jan. 9, 1979

[54] AMMUNITION CASING RESIZER

[75] Inventors: Theodore J. Bachhuber; Philip C. Bachhuber, both of Mayville, Wis.

[73] Assignee: Mayville Engineering Company, Inc., Mayville, Wis.

[21] Appl. No.: 795,980

[22] Filed: May 11, 1977

Related U.S. Application Data

[63] Continuation-in-part of Ser. No. 709,571, Jul. 28, 1976, abandoned.

[51] Int. Cl.[2] ..... F42B 33/02

[52] U.S. Cl. ..... 86/23; 86/36; 86/44

[58] Field of Search ..... 86/23, 24, 25, 26, 27, 86/28, 29, 30, 31, 32, 33, 36, 37, 38, 39, 40, 41, 44; 29/13

[56] References Cited

U.S. PATENT DOCUMENTS

| | | | |
|---|---|---|---|
| 835,480 | 11/1906 | Swaysgood | 86/36 |
| 2,741,148 | 4/1956 | Thompson, Jr. | 86/23 |
| 2,847,895 | 8/1958 | Huntington et al. | 86/36 X |
| 3,025,743 | 3/1962 | Cecchi | 86/44 |
| 3,157,086 | 11/1964 | Bachhuber | 86/31 |

*Primary Examiner*—Harold J. Tudor

*Attorney, Agent, or Firm*—Wheeler, Morsell, House & Fuller

[57] ABSTRACT

For resizing an ammunition cartridge casing, an expandable and contractible collet is surrounded by an axially movable internally tapered sleeve. An axially movable headed shaft for supporting a cartridge casing from its flanged end is in the collet. Shifting the sleeve in one direction opens the collet and simultaneous retraction of the shaft lets the cartridge casing drop into the collet. Shifting the sleeve in the opposite direction causes the collet to contract and resize the cylindrical casing and its flange. Returning the sleeve to its initial position allows the collet to expand and simultaneous elevation of the shaft lifts the resized casing up to the top of a work table in position to be removed by hand or to be moved to a new work station for performance of other steps connected with cartridge reloading if the resizer is built into a reloading device.

29 Claims, 17 Drawing Figures

276
274
275
270
271
231
272
273
248
245
247
256
252
225
267
263
258
276
257
259
237
233
255
240
262
239
260
261
236
254
253
264
234
265
266
235
268
269
232

AMMUNITION CASING RESIZER

BACKGROUND OF THE INVENTION

This is a continuation-in-part of a pending application entitled "Shotgun Shell Resizer," Ser. No. 709,571, filed July 28, 1976, now abandoned.

This invention relates to an ammunition cartridge casing resizer for restoring used shotgun shells and all metallic rifle and handgun ammunition casings to their original shapes in preparation for reloading. The new resizer will be described subsequently in combination with various types of ammunition reloaders with which it cooperates particularly efficaciously and it will also be described as a freestanding device which may be used independently of any particular reloading machine.

Known ammunition casing reloaders have circular work tables upon which several casings are held in an upright position for being sequenced past several circumferentially spaced work stations at which the various operations involved in reloading the casings are performed by reloading tools which are mounted on a tool carriage located above the work table. In some machines, the tool carriage is lowered and in others the work table is raised by a manually actuated lever to simultaneously perform the reloading operations on the casings at the various work stations. The work table and tool carriage are then separated to withdraw the tools from the casings, which are then rotated in unison to the next work station by means of a rotatable indexing carrier on the work table. The carrier has circumferentially spaced radial slots for receiving the flanged end portions of the casings which are being reloaded.

Prior patents which show typical manually operated ammunition reloading machines are U.S. Pat. No. 2,847,895, U.S. Pat. No. 3,157,086 and U.S. Pat. No. 3,973,465. These patents show the tools which are used in some known types of reloaders and the manner in which they act on the casings in connection with the reloading process.

Reloaders which have been used heretofore are capable of performing all of the reloading operations except proper resizing of metallic rifle and handgun ammunition casings and the ferrule portion of casings which are composed of metal and paper such as shotgun shells. The inadequacy of prior resizers results from their resizing by forcing a sleeve-type sizing die over the metallic ferrule portion of a shotgun shell or over a major portion of an all metallic casing. The casing carrier interferes with such operation in a reloader with multiple work stations. Hence, shotgun shells and other casings had to be resized one at a time on a separate resizer before placing them on the multiple station reloading machine for performing the other reloading operations. A disadvantage of these prior resizers is that when a sizing sleeve or die was forced over the casing to size the body of the casing, it forced metal downwardly to expand its flange, the metal being taken from the body of the casing at the expense of its thickness. This degraded the casing and limited the number of reloadings to which it could be subjected.

SUMMARY OF THE INVENTION

The new casing resizer can be mounted on a multiple station reloader without interfering with the movement of the casings from one work station to another. The resizer comprises a casing supporting element or shaft which is mounted under one work station of a multiple station reloader, means for providing relative movement between the casing supporting element and the work table to position the casing below the level of the work table where the carrier does not obstruct the resizing device, an expandable and contractible resizing collet mounted beneath the work table in position to surround the metallic ferrule and flange portion of a shotgun shell or the body of an all metallic casing on the supporting element in its position beneath the work table, means for contracting the resizing collet to resize the ferrule and flange, which it surrounds solely by radial movement which does not force metal down and thin it, and then to expand the collet to free the casing.

The word "collet" as used in this application refers only to a device having a sufficiently large number of gripping fingers movable radially with respect to the axis of the collet and with respect to a casing to be resized so that during closing there is no substantial component of circumferential motion between any part of the respective collet fingers and a casing on which the collet fingers are being closed. The resized casing is subsequently raised back to the top of the work table by actuation of the shaft or the work table is dropped down to the level of the casing where it can be rotated to the next work station along with the other casings on the work table. Thus, the new resizer enables all of the ammunition casing reloading operations to be performed on one multiple station reloader while preserving the integrity of the casings so they may be reloaded many more times. In the preferred embodiment of the resizer, whether it is used in combination with a reloader machine or used separately therefrom, a sleeve is slid over the fingers of the collet to squeeze them radially inwardly to resize the body of the casing without cold flow of metal and to reshape the flange. When the resizer is built into a reloader machine, the sleeve is preferably coupled to the reloader actuation lever through a toggle linkage which produces the high force required to move the sleeve over the collet with application of only a small manual force to the operating lever.

Several embodiments of the new resizer will be described herein all of which may be considered preferred embodiments for their particular application. Thus, the combination of the resizer and a shotgun shell reloader with which it coacts will be described. The combination of the resizer and a reloader for all metal casings with which the resizer coacts will also be described. The resizer will also be described in combination with various styles of reloaders and as a device which is usable independently of any particular kind of reloader. Unique features which are common to all embodiments will also be described.

DESCRIPTION OF A PREFERRED EMBODIMENT

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

Figure 1:
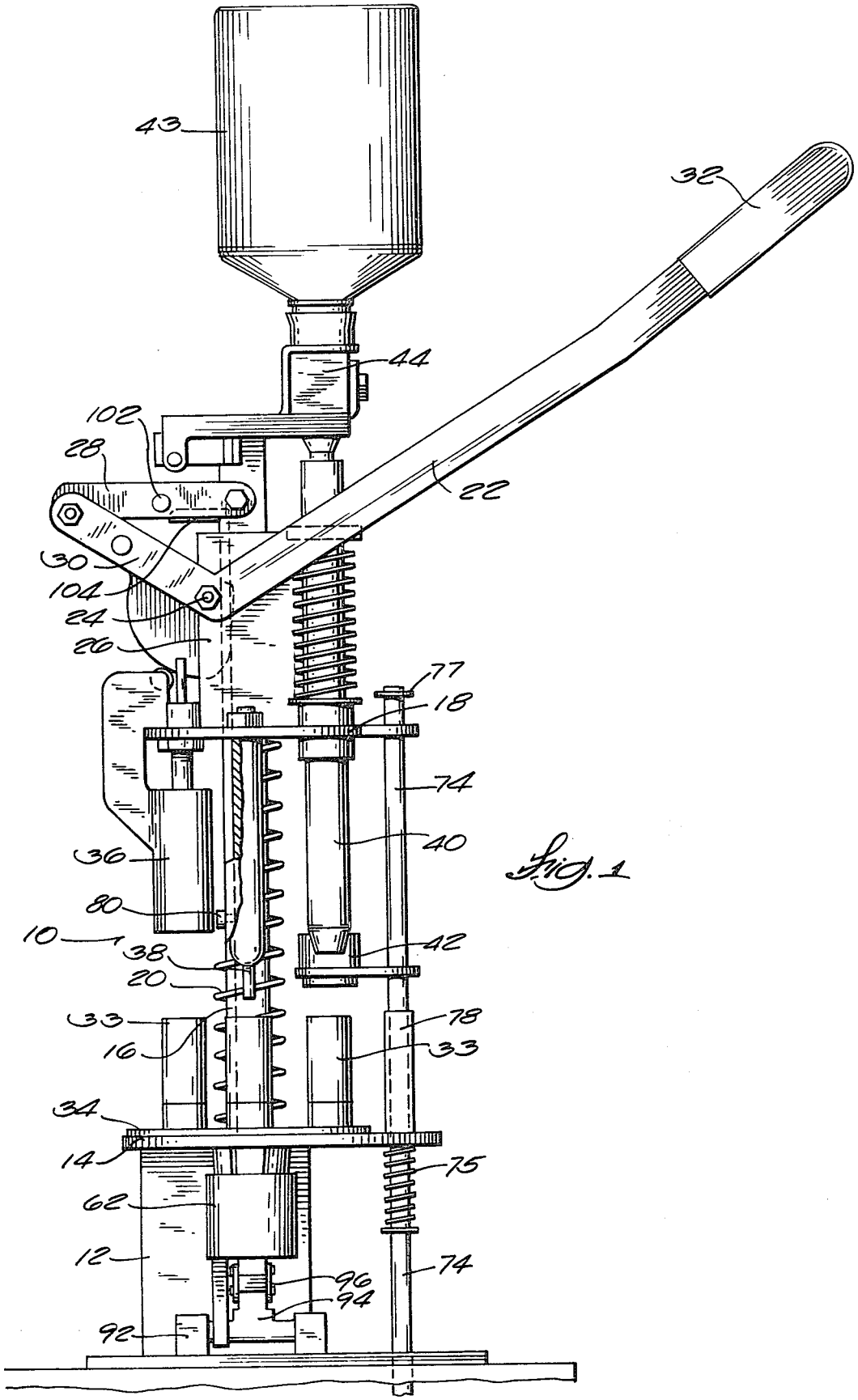
FIG. 1 is an elevational view of a multiple station shotgun shell reloader on which a shotgun shell resizer of this invention is mounted.

Referring to FIG. 1, a preferred embodiment of this invention in a shot gun shell reloader combination will be described first. The new resizer is mounted on a multiple station reloader 10 which includes a base 12, a circular work table 14 rigidly attached to base 12, a supporting post 16 rigidly attached to base 12 and extending upwardly therefrom, a circular tool carrier 18 slideably mounted on post 16, a main spring 20 urging tool carrier 18 to it uppermost position, a V-shaped manual actuating lever arm 22 pivotally attached at 24 to a collar 26 on tool carrier 18, and a link 28 pivotally connecting the short end 30 of a lever arm 22 to post 16. When the handle 32 on lever arm 22 is lowered it lowers tool carrier 18 against the force of spring 20 and moves the reloading tools thereon toward work table 14 to perform reloading operations on shotgun shells 33 which are placed in an upright position on work table 14 and are held in position by a shell carrier disc 34 which has circumferentially spaced slots 35 (FIG. 2) for receiving and holding the shells. The reloading tools include a crimper 36, primer removing punch 38, powder refilling tube 40, wad guide 42 and other conventional reloading tools. Containers 43 for powder and shot are mounted on top of metering apparatus 44 which is rigidly attached to the top of post 16. However, the operation of these reloading tools will not be described herein since they are well known and are described in prior patents such as U.S. Pat. No. 3,157,086. The work table 14 has multiple work stations thereon, each one located under a corresponding reloading tool, but the only work station of interest for the purpose of this application is the work station at which the ferrule resizing is done, which in this embodiment is the work station under primer punch 38.

Figure 2:
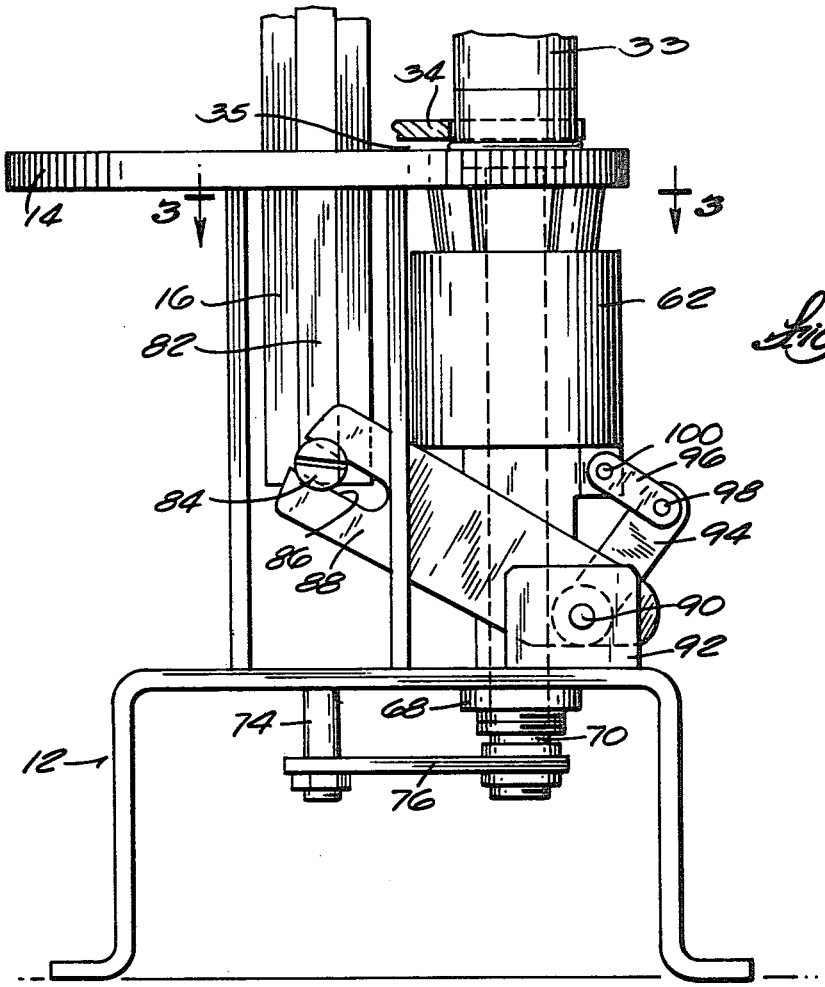
FIG. 2 is an enlarged detail elevational view of the shotgun shell resizer with the shell supporting element thereof in its raised position and the resizing collet thereof in its expanded condition.
Figure 3:
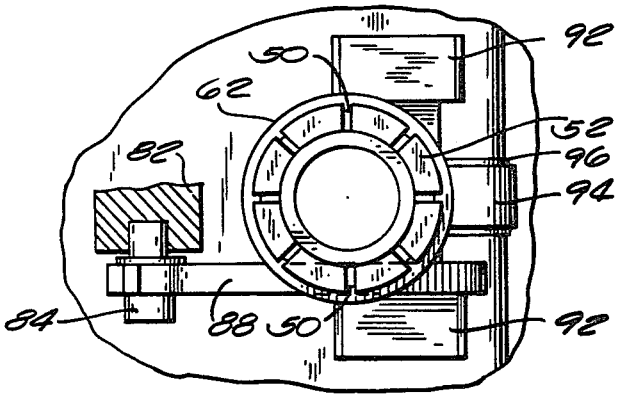
FIG. 3 is a detail cross-sectional view taken on the line 3—3 in FIG. 2.
Figure 4:
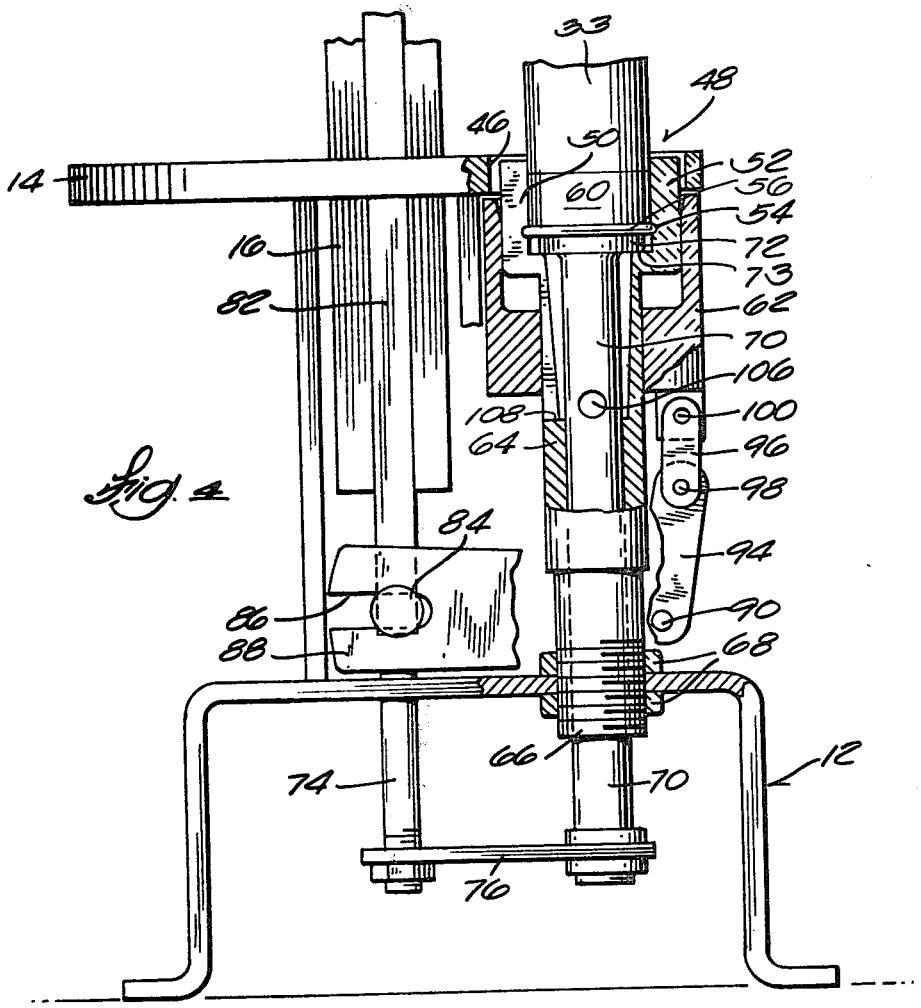
FIG. 4 is an enlarged detail elevational view similar to FIG. 2 with the shell supporting element in its lowered position and the resizing collet thereof in its contracted condition, portions of the resizer being cut away to reveal inner details.

Referring to FIGS. 2, 3 and 4, the ferrule resizing apparatus is mounted under work table 14 and is accessible through a circular opening 46 (FIG. 4) in work table 14 centered under primer punch 38. The ferrule resizing apparatus includes a hollow expandable and contractible resizing collet 48 which is shaped at its upper end to surround the ferrule portion of a shotgun shell to resize the same. The upper portion of collet 48 has a plurality of vertical radial slots 50 (FIG. 3) which divide the collet into a plurality of spaced segments 52. The interior surface of each collet segment 52 is circumferentially slotted at 54 (FIG. 4) to receive the flange 56 of a shotgun shell 33 and is shaped to resize the shotgun shell ferrule 60 and flange 56 when the collet segments 54 are squeezed together as described hereinafter by forcing a collet sleeve 62 thereover.

Resizing collet 48 has a downwardly extending stem portion 64 (FIG. 4) which is threaded at its lower end 66 and extends through an opening in base 12. Lower stem portion 66 of collet 48 is attached to base 12 by nuts 68.

A hollow cylindrical shotgun shell supporting member 70 which has a flanged top 72 is slideably mounted within collet stem 64 and can be raised and lowered to drop shotgun shell flange 56 and ferrule 60 into resizing collet 48 for resizing and then to lift ferrule 60 back to the level of work table 14 after resizing. In its lowermost position, flange 72 rests on lips 73 on collet segments 52. Shell supporting member 70 is raised and lowered by rod 74 (FIGS. 4 and 1) which raises and lowers wad guide 42 when manual actuating lever 22 is raised and lowered. Rod 74 is spring biased downwardly by spring 75. The bottom end of rod 74 is rigidly attached to the bottom end of shell supporting member 70 by a conventional linkage 76. Rod 74 does not continue to move during the entire downward stroke of manual actuating lever 22, but only during the initial portion thereof. The downward movement of rod 74 is limited by abutment of a spacer sleeve 78 on rod 74 with the top of work table 14. This movement limiting arrangement for rod 74 is conventional since the downward movement of wad guide 42 has to be arrested when it reaches the open end of a shotgun shell therebelow.

Figure 5:
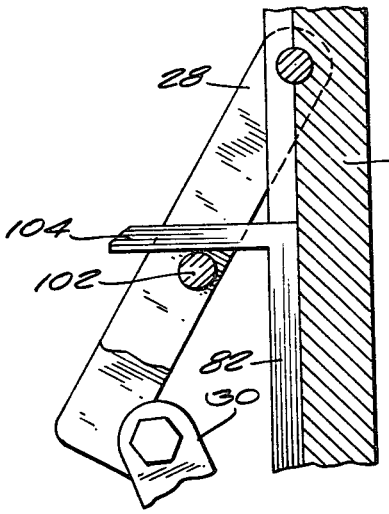
FIG. 5 is an enlarged detail view of a portion of the actuating arm which serves to lower the resizing sleeve when the actuating lever is raised.

The above-described downward movement of shotgun shell supporting member 70 serves to lower the shotgun shell 33 below the top of work table 14 into alignment with the expanded resizing collet 48 so that shotgun shell flange 56 and ferrule portion 60 is in position to be resized when the expanded segments 52 of collet 48 are squeezed together. As the downward stroke of manual actuating lever 22 continues, tool carriage 18 engages a lug 80 (FIG. 1) projecting from a slide 82 within post 16 and forces slide 82 downwardly. The lower end of slide 82 has a lug 84 (FIGS. 2 and 4) which is slideably engaged in a slot 86 in one end of a rocker arm 88. The other end of rocker arm 88 is pivotally connected at 90 (FIG. 2) to a pair of brackets 92 which are rigidly attached to base 12. A toggle arm 94 is rigidly attached to rocker arm 88 and projects approximately at right angles therefrom. Toggle arm 94 is pivotally connected to collet sleeve 62 by a toggle link 96 and conventional pintles 98 and 100. As slide 82 is moved downwardly, rocker arm 88 rotates counterclockwise in FIGS. 2 and 4 and forces collet sleeve 62 upwardly over the exterior surface of resizing collet 48, thereby squeezing collet segments 52 together to provide inward pressure on shotgun shell flange 56 and ferrule 60 to resize the same. The toggle linkage which drives collet sleeve 62 helps, due to its inherent characteristics, in achieving the relatively high level of force required to slide sleeve 62 over collet 48. When manual actuating lever 22 is subsequently raised, a pin 102 (FIGS. 1 and 5) on line 28 engages an arm 104 which projects outwardly from slide 82 and forces slide 82 upwardly. Direct upward force is required in this embodiment to return slide 82 to its initial position due to the force developed between collet sleeve 62 and resizing collet 48. As slide 82 is driven back toward its initial position, rocker arm 88 is rotated clockwise in FIGS. 2 and 4 and lowers resizing sleeve 62, thus permitting collet segments 52 to expand due to the natural spring action of the material from which resizing collet 48 is made. The material for collet 48 is selected and suitably shaped so that collet segments 52 will return to their expanded position when resizing sleeve 62 is lowered. After sleeve 62 is lowered, the further upward movement of manual actuating lever 22 causes rod 74 to rise due to contact with a snap ring 77 thereon (FIG. 1) and this raises shotgun shell supporting member 70 and lifts the resized shotgun shell ferrule 60 back to the top of work table 14 in position to be carried by shell carrier 34 to the next work station.

Location of resizing collet 48 below work table 14, along with the means for lowering shotgun shell 33 into resizing collet 48 and then lifting shell 33 back up to the level of work table 14, (or raising and lowering work table 14 to achieve the same effect) are important features of the invention because they allow the resizing to be performed on a multiple station reloading tool without interfering with the movement of the shotgun shells from one work station to another; and without the use of a downward moving resizing sleeve which would strike the shell carrier in operation, preventing its use on this type of machine, and which further had a tendency to force the brass of the shell ferrule down into the shell flange. The latter eventually expands the flange to unusable size, whereas the present device resizes both ferrule and flange.

Although this embodiment utilizes a fixed work table 14 and a movable tool carriage 18, the invention can also be applied to reloaders which utilize a fixed tool carriage and a movable work table as will be shown subsequently.

In the above described preferred embodiment, a cross-bore 106 (FIG. 4) is drilled through shotgun shell supporting member 70 near the bottom 108 of the slots 50 in collet 48. Cross-bore 106 enables foreign material such as spilled powder to pass from the interior of collet 48 to the interior of shell supporting member 70 and then to drop out of the reloader through the hollow interior of shell supporting member 70. The mechanical shock caused by flange 72 dropping down on lip 73 vibrates collet 48 and shell supporting member 70 and causes the foreign material to move through cross-bore 106.

Now that the combination of a shotgun shell reloader and cartridge resizer have been described, attention is invited to FIGS. 6–9 for a description of the resizer in combination with a reloader that is especially adapted for handling all metal cartridge casings. Parts in this embodiment which are similar to parts in the previously described embodiment will be given the same reference numerals except that they will be increased by a value of 100.

Figure 6:
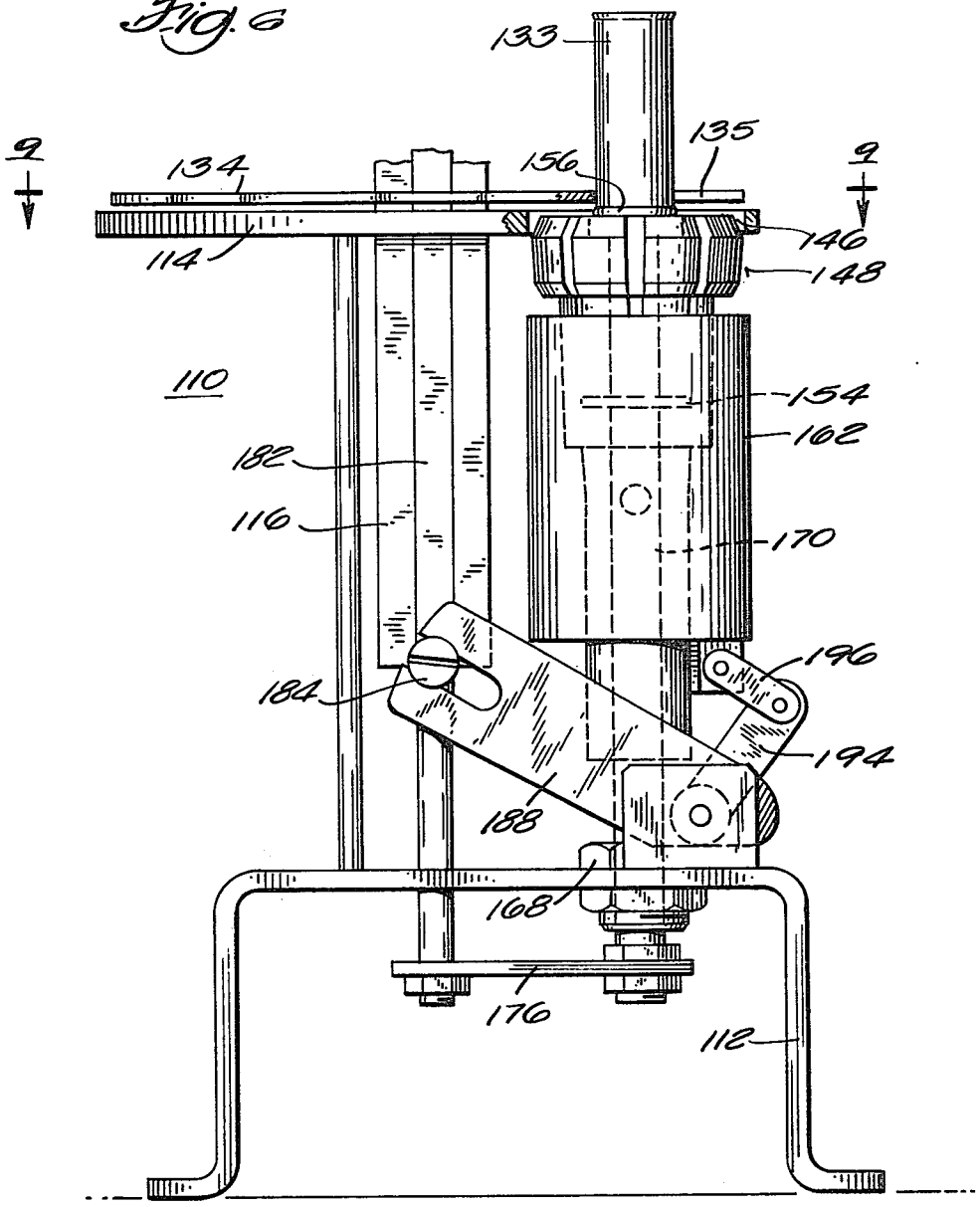
FIG. 6 is an enlarged detail elevational view of a resizer in combination with an all metal ammunition casing reloader, with some parts omitted, showing the shell supporting element or shaft within the collet in its raised position and the resizing collet in its expanded condition.

In FIG. 6, the collet 148 is disposed within an axially movable sleeve 162. The sleeve is actuated by toggle linkage including links 196, 194 and 188. The latter link is rocked counterclockwise in FIG. 6 by the downward force generated by movement of slider 182 downwardly and letting the lug or pin 184 rock link 188. A headed shaft or casing support 170 is coaxial with the collet and sleeve. Shaft 170 is connected to vertically reciprocable slider 182 with a link 176. The slider and shaft move correspondingly.

In FIG. 6, a typical all metal ammunition casing 133 is being supported on the upper or headed end of supporting shaft 170 and the collet 148 is spread open because sleeve 162 is in its downward position. Metal casing 133 has been advanced so that its flange 156 will align with shaft 70 by rotation of disc 134. The disc has a plurality of slots such as 135 for accommodating several circumferentially arranged casings. The upper end of the collet extends into an opening 146 in the immovable work table 114.

Figure 7:
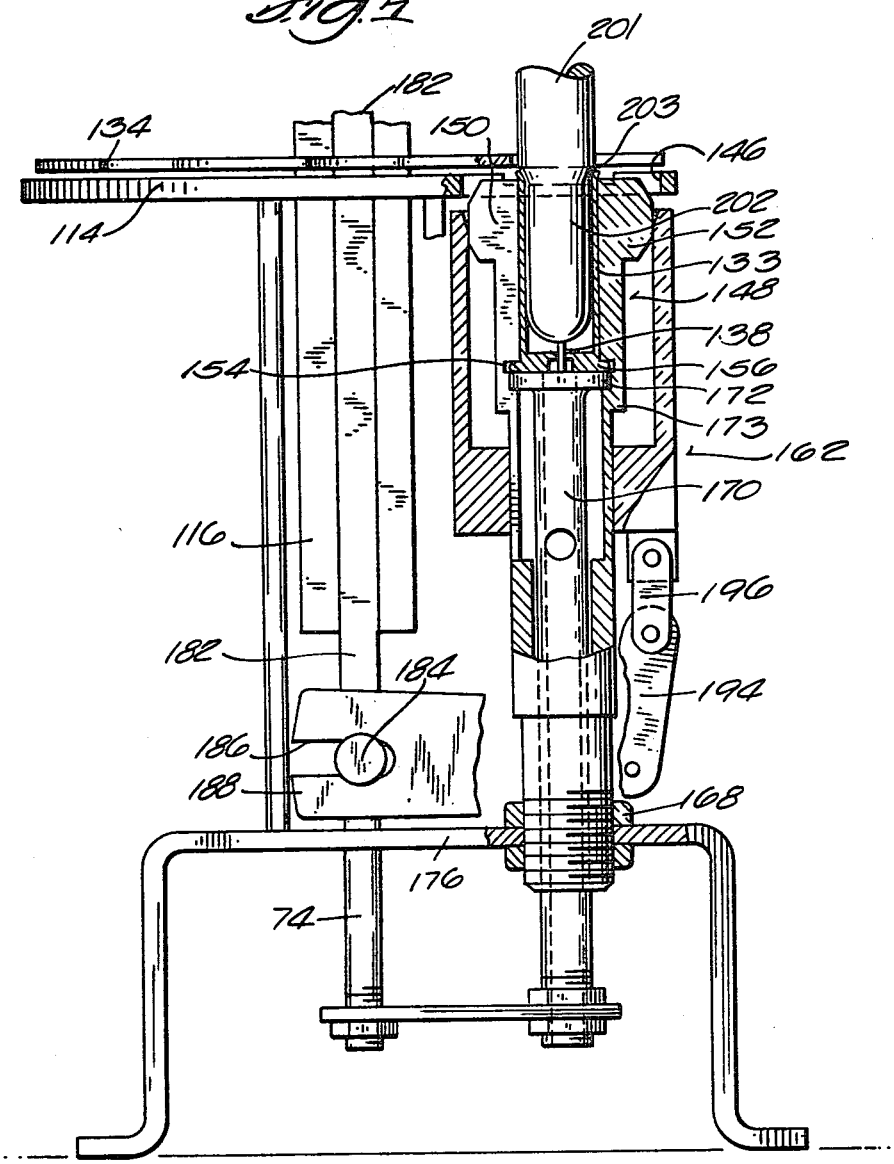
FIG. 7 is a view similar to FIG. 6 showing the casing supporting element in its lowered position and the resizing collet in its contracted condition, some portions of the resizer being shown in section and others being broken away to reveal the inner details.

In FIG. 7, the mechanism has gone through the sequence of having shaft 170 move downwardly and sleeve 162 moved upwardly. This series of events resulted in the sleeve compressing the segments 152 of collet 148 inwardly to compress the casing 133 and resize it. An internal die 201 is also brought down at this time. This die has a portion 202 of reduced diameter which is equal to the desired diameter of the interior of casing 133. This assures that all dimensions of the casing will be held to acceptable tolerances. Note that at the junction of reduced portion 202 and the larger diameter portion 201 of the die there is a chamfered shoulder 203 which enters the upper rim of the casing and flares it outwardly by a small amount. Reduced portion 202 also has a tip 138 for expelling a spent primer from the flanged end of the casing. The primer is dropped down through the bore in shaft 170.

The inside faces of the segments 152 which comprise the collet are provided with an annular groove 154 which has a shape that is complementary to the desired resized or reshaped rim of the flange 156 on the casing.

As in the embodiment which was described first, when the manual operating lever 22 is raised, the shaft 170 is moved upwardly and sleeve 162 in FIG. 7 is moved downwardly to release the collet and allow its segments to expand outwardly in which case the rim of flange 156 is clear of grooves 154 in the segments. Concurrent upward movement of shaft 170 restores the casing to the position in which it appears in FIG. 6.

Figure 9:
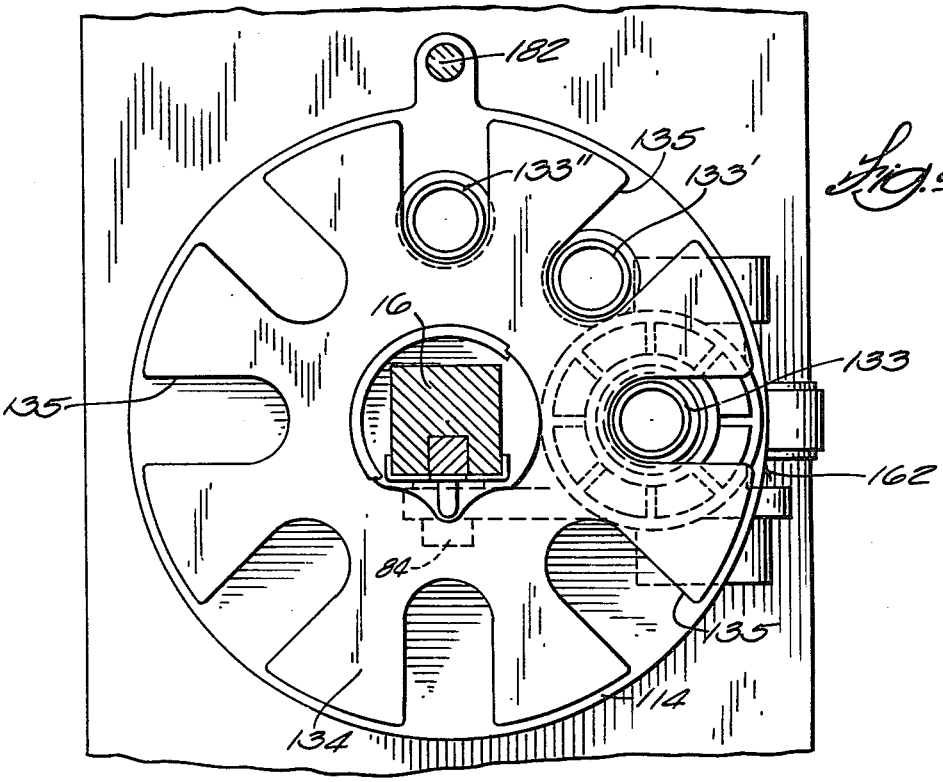
FIG. 9 is a cross-sectional or essentially plan view taken on the line 9—9 in FIG. 6.

In FIG. 9, three casings 133, 133' and 133" are shown. Each is subject to being transported circumferentially by rotation of disc 134 since each is within one of the slots 135 in the disc. The various tools, not shown in FIG. 9, for filling or performing other functions on the casings are arranged in a generally circular pattern over the various slots 135 which bring the casings to various angular positions through rotation of disc 134.

Figure 8:
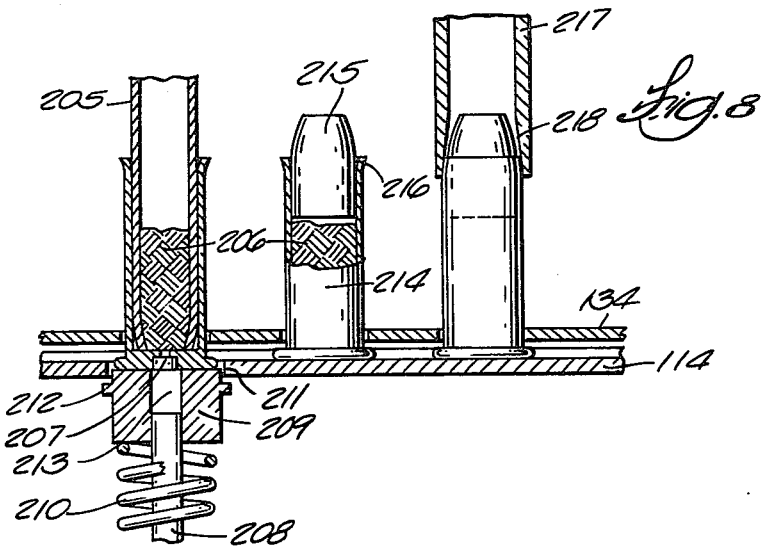
FIG. 8 shows several all metal casings on the work table of a reloader where various reloading operations are performed.

In FIG. 8, three casings at different work stations are shown. They are captured in the slots of disc 134 and have their flanges essentially coplanar with the top of work table 114.

The casing farthest to the left in FIG. 8 is entered by a tube 205 for inserting powder 206 into the casing. Downward movement of powder filling tube 205 also effects setting a new primer 207 in the end of the casing. For this purpose, a stationary rod 208 is provided. A sliding collar 209 is on the rod. The collar is biased upwardly with a spring 210. The top end of the collar extends through a hole 211 in work table 114. Upward travel of the collar is limited by its shoulders 212 abutting against the bottom surface of work table 114. Before casing 205 arrives at the work station in which it is shown, a primer 207 is deposited in the bore 213 of the collar for the primer to rest on the top of rod 208. When the casing is indexed to the position in which it rests on collar 209, the downward force of the filler tube 205 drives the casing and collar downwardly in opposition to the force of spring 210 to thereby drive the primer which is resting on top of rod 208 into the flanged end of the casing. The filler tube is then retracted and a metered quantity of powder 206 is admitted following which the filler tube is withdrawn.

At the adjacent station in FIG. 8, a casing 214 is at a work station in which the bullet 215 is inserted. At this time the rim 216 of the casing is still flared as shown. At an adjacent work station, a generally tubular tool 217 is brought down for its internally beveled end 218 to slide over the flared part 216 and crimp it inwardly so that it makes good compressive engagement with the bullet.

Figure 10:
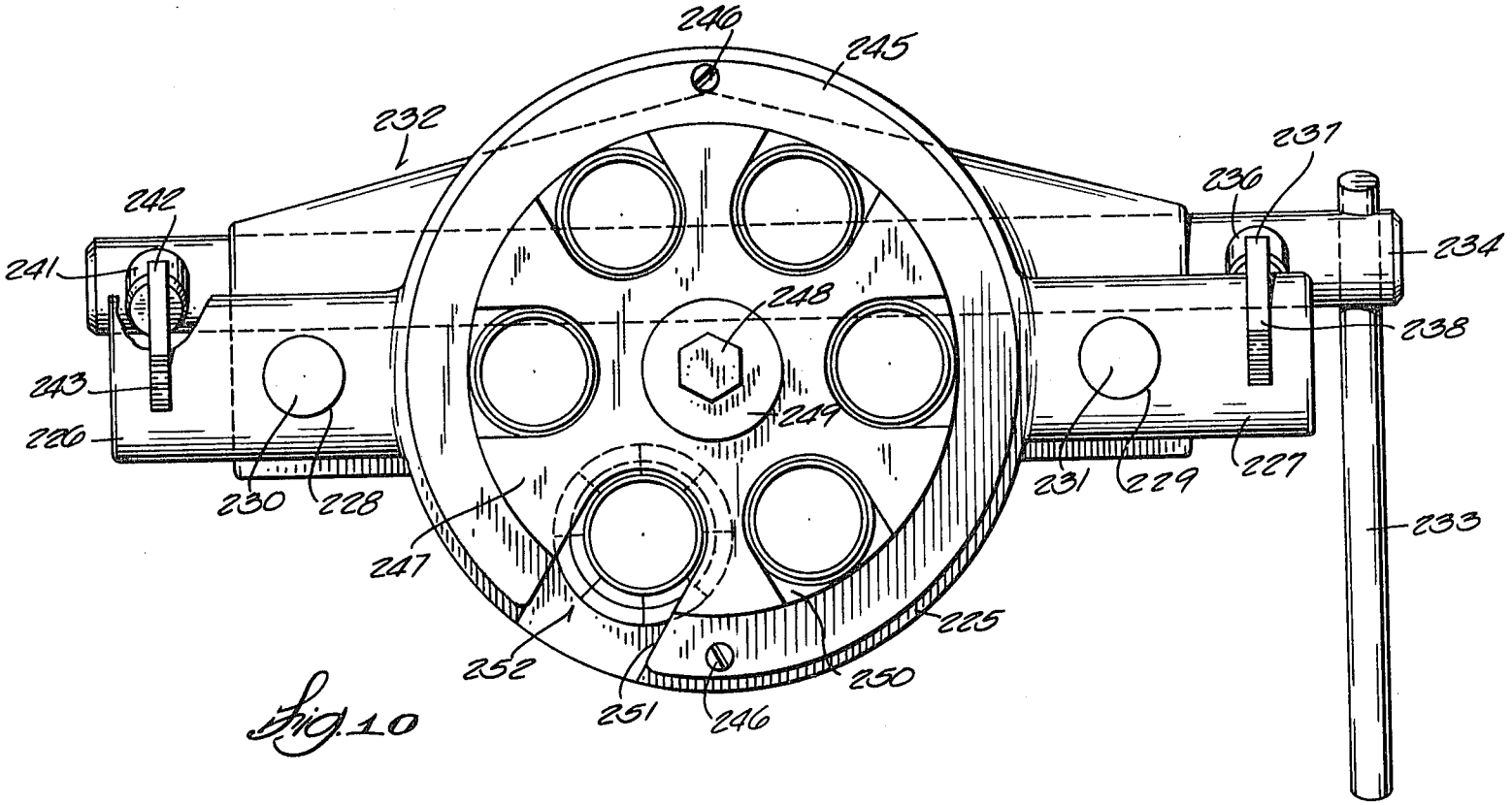
FIG. 10 is a plan view of another embodiment of a reloader, with some parts being omitted, which incorporates the new resizer.
Figure 11:
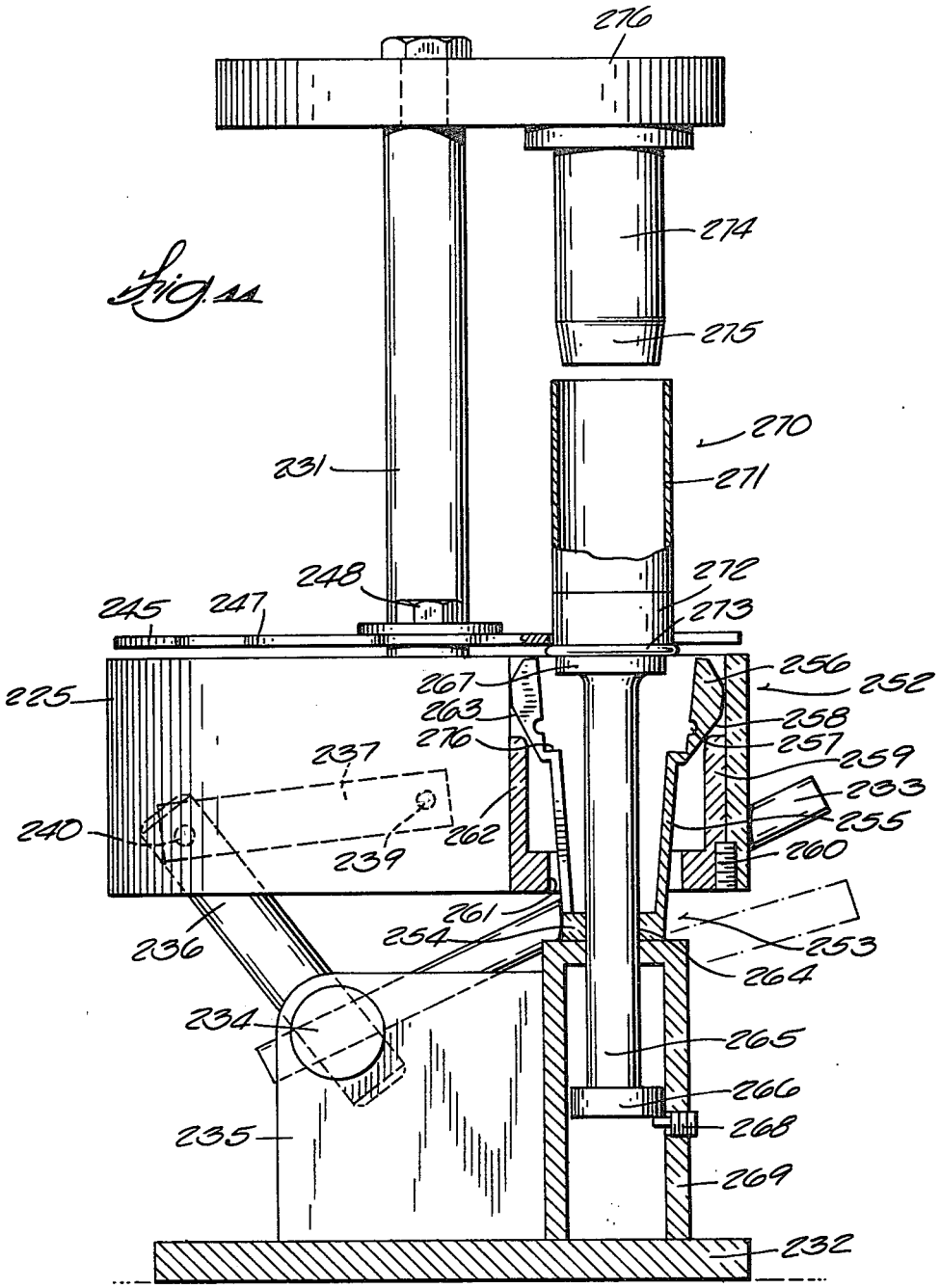
FIG. 11 is a side elevational view of the embodiment shown in FIG. 10 with some parts being added and parts of the resizer being shown in section, wherein the collet is open and a casing is supported on its shaft prior to the resizing operation.
Figure 12:
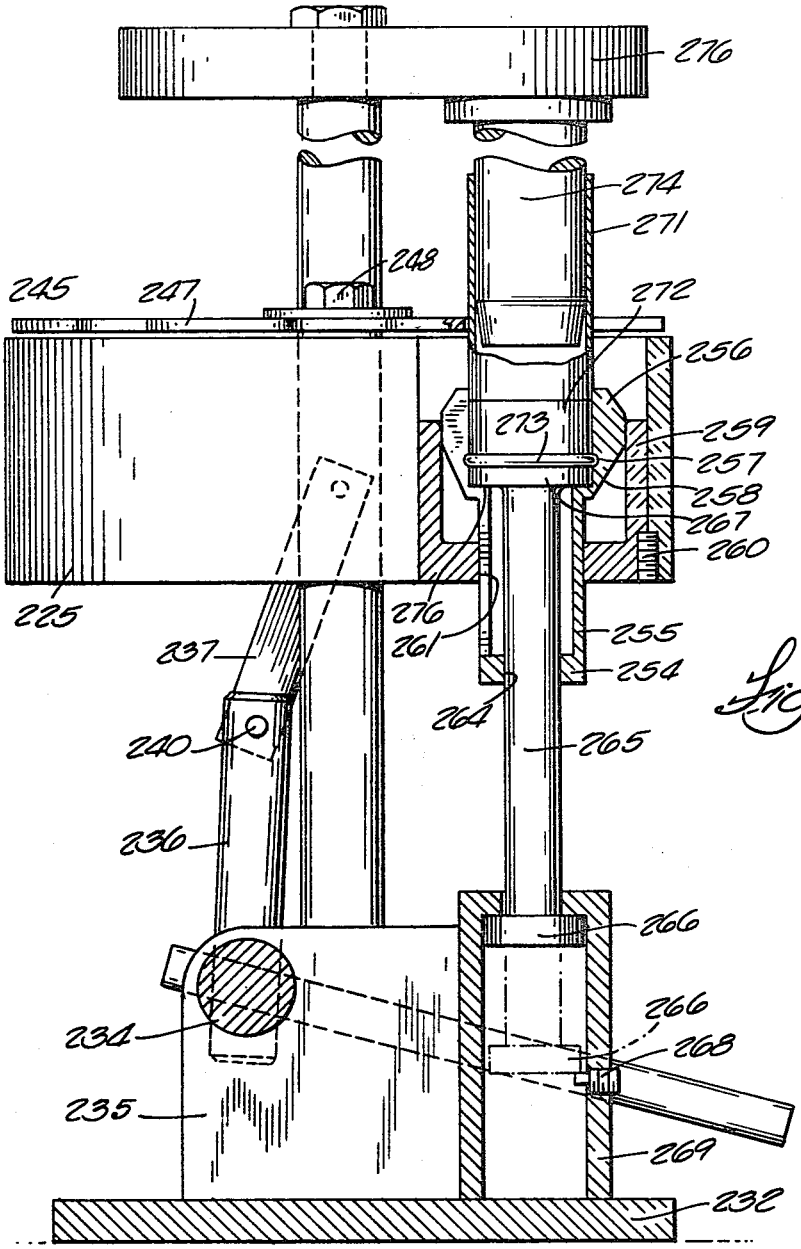
FIG. 12 is similar to FIG. 11 except that it shows the collet closed and exerting the forces incident to resizing.

FIGS. 10–12 show another embodiment of a reloader in which a casing resizer, particularly a shotgun shell resizer, is incorporated. In this embodiment, parts of the resizer will be given reference numerals which have not been used nor do they necessarily relate to those which have been used before.

Referring to FIGS. 10–12, one may see that the reloader comprises a cylindrical body 225 which has integral opposed laterally extending wings 226 and 227. The wings are provided with bores 228 and 229 that serve as linear bearings to enable the arms and cylinder to slide in opposite vertical directions on a pair of upstanding rods 230 and 231. These rods are anchored in a base 232. Cylinder 225 is moved up and down manually with an actuating lever 233 that is fixed in a cross shaft 234. The cross shaft 234 is journaled in a pair of laterally spaced apart bosses such as the one marked 235 in FIG. 11. The bosses may be cast integrally with base 232. Cylindrical body 225 is actuated vertically on rods 230 and 231 with a lever and link system such as the lever 236 and the link 237. As can be seen in FIG. 10, link 237 extends into a slot 238 where it is pivotally connected to one of the side arms 227 of the cylindrical body. The pivot point is marked 239 in FIG. 11. Link 237 is also pivotally connected to an end of lever 236 and the pivot connection is marked 240 in FIG. 11. Lever 236 extends through cross shaft 234 in which it is pinned. As can be seen in FIG. 10, another lever 241 extends from the cross shaft and it is pivotally connected to a link 242 which in turn fits into a slot 243.

In FIG. 11, the operating lever 233 is angulated upwardly in which case cylindrical body 225 is near its lowermost position. In FIG. 12, manually operable lever 234 has been angulated downwardly such that cross shaft 234 has been rotated in which case the lever 236 and link 237 become more aligned with each other such as to force the body 225 upwardly.

Referring to FIG. 10, one may see that a flat ring 245 is fastened to the top of cylindrical body 225 with screws such as 246. A disc 247 having a thickness essentially the same as that of ring 245 is mounted for rotation inside of ring 245 about a hexagon headed stud shaft 248 which passes through a washer 249. Disc 247 has a plurality of radially extending slots such as the one marked 250. The slots engage the flanged ends of the ferrules of shotgun shells for serving in the manner of a turret to transport the shells circumferentially to various work stations.

In FIG. 10, one may see that ring 245 has a slot 251 which will align with one of the slots 250 in the rotatable disc 247 when the disc is suitably rotated such as to the position in which it is shown in FIG. 10. In this figure, the resizer which is generally designated by the reference numeral 252 is located under these slots.

Attention will now be focused on construction and operation of the resizer 252 primarily in reference to FIGS. 11 and 12. In these figures, the resizer compriseas a collet which is generally designated by the reference numeral 253. It comprises an annulus 254 which has a circumferential array of spring fingers or segments 255 extending integrally from it. In FIG. 11, the segments are shown diverged outwardly under the influence of their inherent springiness. The segments each comprise a jaw portion 256 in which there is a groove 257. When the segments are contracted, the grooves 257 in each of them form a continuous circular groove. The outer surfaces 258 of the collet jaws are beveled as shown in FIG. 11. A sleeve 259 is fixed in body 225 with screws such as 260. The sleeve has a central hole 261 and a side wall 262. The inside perimeter of the side wall is rounded or chamfered as at 263. Extending freely through an aperture 264 in collet annulus 254 is a shaft or cartridge casing support 265 which has a stop flange 266 fastened to its lower end and an integral flange 267 at its other end. The support member or shaft 265 is preferably hollow. Downward travel of casing support shaft 265 is limited by flange 266 striking the tip of a set screw 268 which is screwed into the wall of a tubular support 269.

In FIG. 11, cylindrical body 225 is substantially in its lowermost position. A shotgun shell 270 which is involved in the reloading sequence is resting on flange 267 of elongated support 265. The shell comprises the usual paper tubular portion 271, a metallic ferrule portion 272 and a flange 273 on the ferrule. A die 274 having a tapered end 275 is shown supported on an arm 276 above the shell when it is in this particular work station. It will be evident that if body 225 is elevated by actuation of manual lever 233 from the position in which it is shown in FIG. 11 to the position in which it is shown in FIG. 12, the paper tubular portion 271 will be forced onto forming die 274 to thereby reshape the paper tube into a perfect circle again.

When body 225 is elevated as just described, it will be evident from observing FIG. 12 that sleeve 259 will act on the beveled portions 258 of the collet jaws 256 and squeeze them radially inwardly. Because of their circular contour, the jaws will reshape ferrule 272 circularly. Flange 273 on the ferrule will also be properly reshaped by the annular grooves 257.

Note in FIGS. 11 and 12 that the ends of the collet segments form shoulders 276. As the sleeve 259 moves upwardly, these shoulders engage the bottom surface of supporting flange 267 and carry the support 265 up with it. In FIG. 11, it is evident that when body 225 is lowered and the collet jaws opened, support 265 is free to fall until it strikes stop pin 268 in which case it supports the shell at a level on the work table which enables it to be indexed to the next work station by rotation of turret disc 247.

Figure 14:
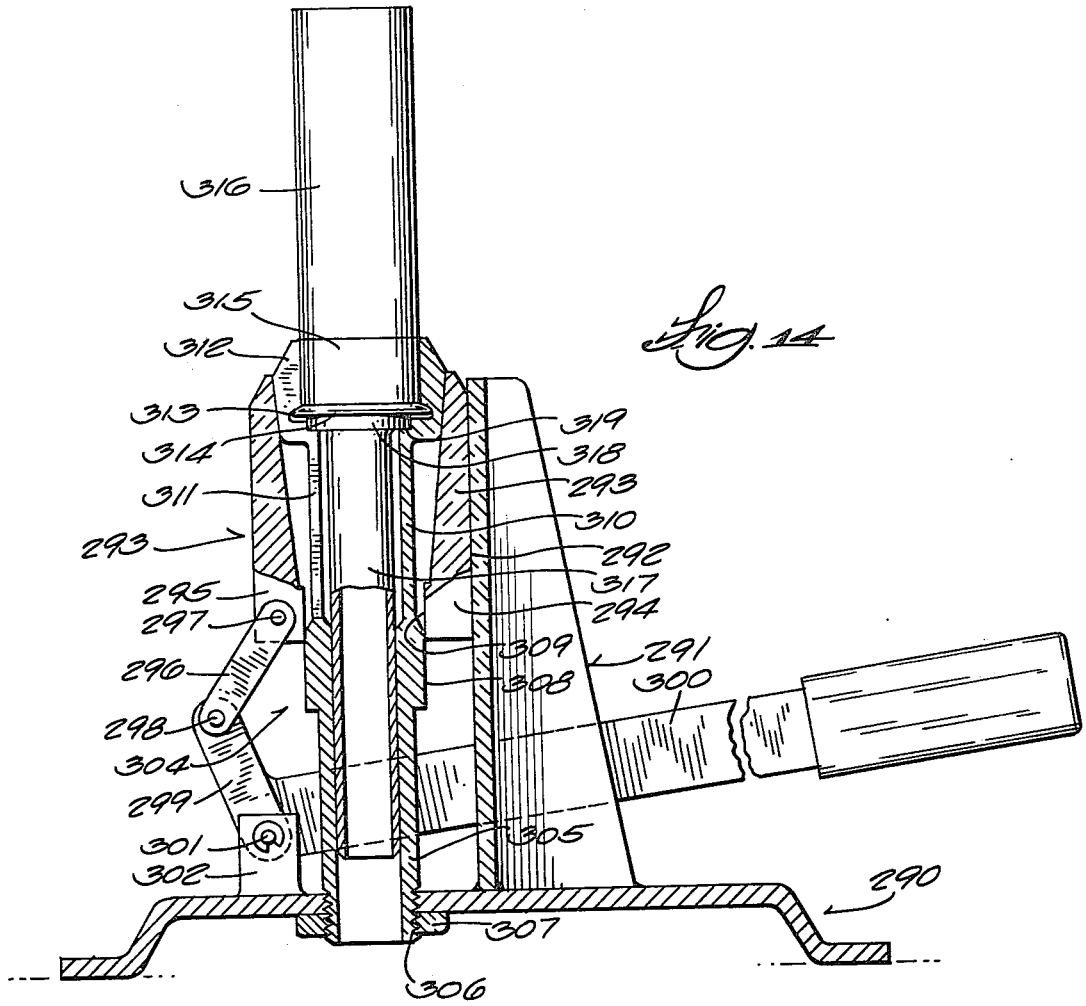
FIG. 14 is a side elevational view of the resizer shown in FIG. 13 with some parts being shown in section, wherein the collet is being pressed radially inwardly to reshape the ferrule and flange of a shotgun shell.
Figure 13:
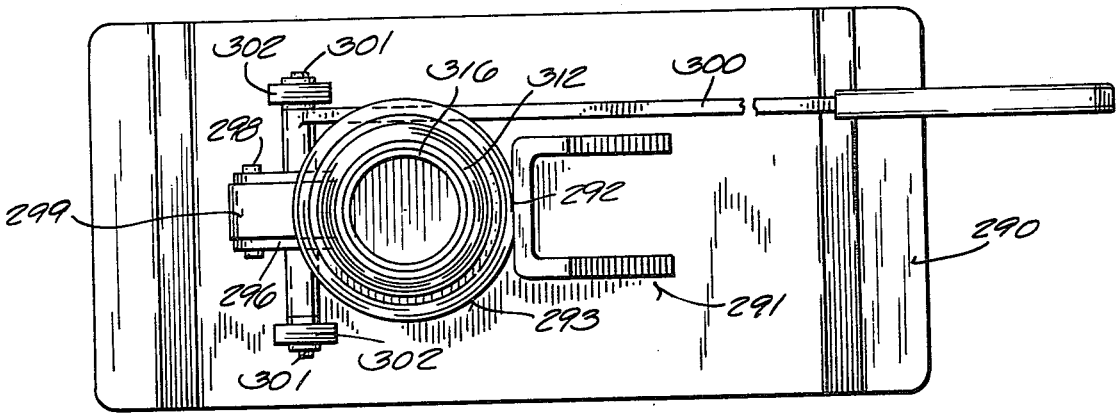
FIG. 13 is a plan view of a freestanding resizer, in accordance with the invention, apart from any casing reloading machine.

An embodiment of the new resizer which is not built into a reloader will now be described in reference to FIGS. 13–15. It comprises a base 290 on which an upstanding guide bracket 291 is fastened. One side of the bracket has a flat face 292. A collet operating sleeve 293 is adapted for reciprocating vertically on flat face 292. Thus, although sleeve 293 is generally circular, it has a flat side 294 from which a flat sided integral rib 294 extends. The other side of the sleeve has a similar rib 295. A link 296 is pivotally connected at 297 to rib 295. Link 296 also pivotally connects at 298 to an arm 299 which is part of a manual operating lever 300. This lever is mounted for pivoting on a shaft 301 which is supported by brackets 302 and 303 which are preferably welded to base 290. Operating lever 300 is pressed down to raise sleeve 293 as in FIG. 14 and is elevated to lower sleeve 293 as in FIG. 15.

The resizing collet is generally designated by the numeral 304. It comprises a tubular portion 305 which has a thread 306 at one end for securing it in a correspondingly threaded hole in base 290. A lock nut 307 is used on the threaded end of the collet. The collet has a circular linear bearing portion 308 on which the similarly circular interior bearing surface 309 of the sleeve glides. The collet in this case as in the previous embodiments has several springy segments such as the one marked 310 which have slots between them as indicated at 311. The segments terminate in jaw portions 312 in each of which there is a groove 313 for accommodating the flange 314 on the ferrule 315 of a shotgun shell 316 or other ammunition casing. A tubular casing support 317 is disposed in the collet. This support has a flange or head 318 at its upper end on which the casing is supported. As shown in FIG. 14, sleeve 293 is raised by previous actuation of manual lever 300 and the collet segments are contracted or pressed inwardly by the sleeve. Thus, the jaw surfaces above grooves 313 apply compressive force on ferrule 315 to resize it and shape it circularly. The configuration of grooves 313 is such that it properly shapes flange 314 of the casing. Flange 318 on the top of support 317 cannot descend since it is reacting against internal shoulders 319 on the collet segments. Thus, when the collets are pressed inwardly, flange 318 is constrained to react against the end face of the casing flange 314 and thus correct any bulge which it may have had.

Figure 15:
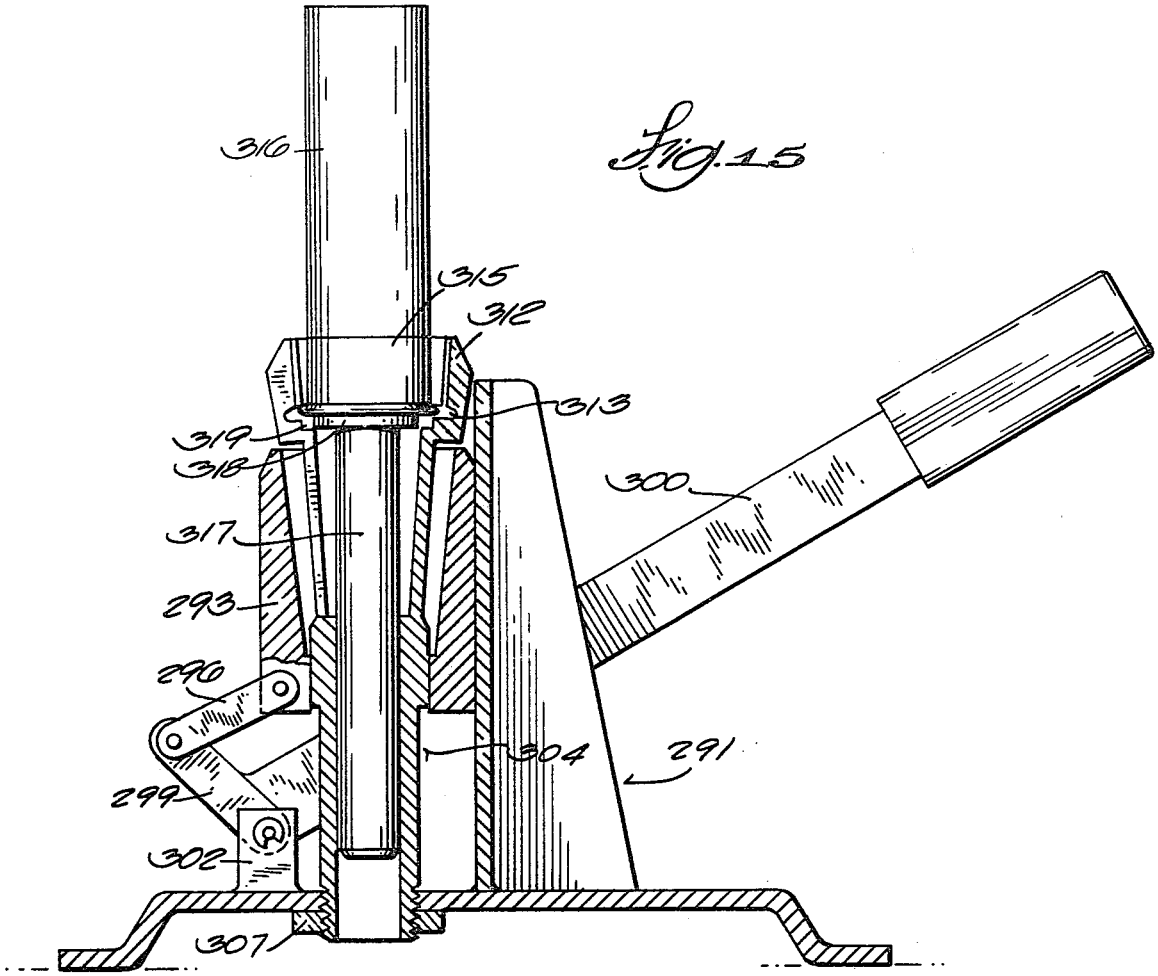
FIG. 15 shows the resizer of FIG. 14 in a condition wherein the shotgun shell is released from the collet for removal.

FIG. 15 shows the resizer actuated for either accepting a shotgun shell 316 before it is resized or for releasing a shell that has been resized. When sleeve 293 is moved upwardly as it is in FIG. 15 by actuation of lever 300, tubular support 317 and its flange 318 remain at a constant level by virtue of the support derived from shoulders 319.

Figure 16:
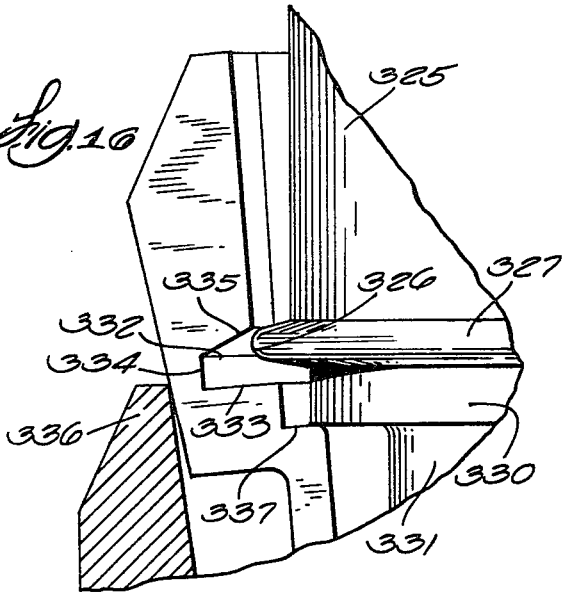
FIGS. 16 and 17 are enlarged fragmentary views of portions of the resizer collet to bring out the details on how the resizer acts on the flanged end of a casing to remedy a bulge in the end and reshape the flange.
Figure 17:
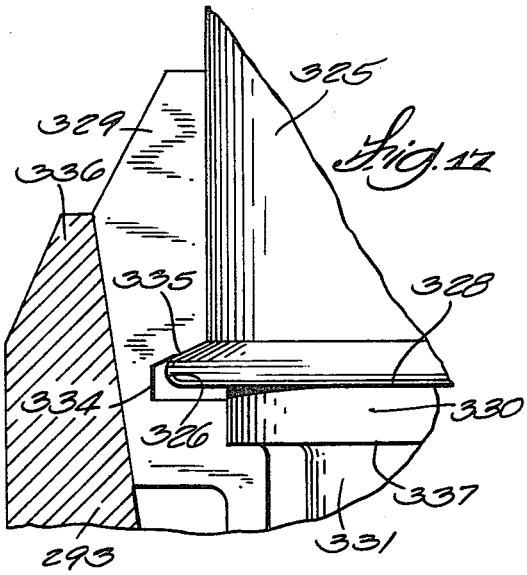

FIGS. 16 and 17 are enlargements of parts of the collet which are involved in resizing and reshaping the flange and end face of a casing. In FIG. 16, a fragment of a ferrule 325 of a shotgun shell is shown. Due to the shell having been fired, the periphery 326 of its flange 327 has been deformed and the face 328 of the flange has been bulged out as shown. The collet jaws 329 are open and the shell is resting on the flange or head 330 of elongated support 331. The magnified groove 332 of each of the collet jaws has a straight surface or shoulder 333, a peripheral surface 334 and a tapered surface 335. In FIG. 16, sleeve 336 is still lowered and the collet jaws are open.

In FIG. 17, sleeve 336 has been moved upwardly to force the collet jaws 329 inwardly to apply uniform radially inwardly directed force on ferrule 325. The beveled surface 335 has approached the periphery 326 of the casing flange in such manner that it applies a compressive force to the shell flange and imparts the proper shape to it. The support flange 330 at this time is backed up by shoulders 337 on the collet segments so flange 330 is constrained against downward movement in which case it exerts a force against the face 328 of the casing flange and straightens it. Thus, the resizer in this and the previous embodiments not only resizes and reshapes the longitudinal portions of a casing but reshapes and resizes at least one end of it as well.

We claim:

1. In a resizer for the flange and tubular portion of a cartridge casing, comprising a frame, a work table mounted on said frame, means on said work table for receiving the flanged end of a plurality of casings and for moving said casings over a plurality of work stations on said work table, the improvement comprising a casing supporting member mounted under one work stations of said work table, means for producing relative motion between said casing supporting member and said work table to move said casing supporting member from a position level with the top of said table to a position below said table, a radially expandable and contractible resizing collet having a sufficiently large number of gripping fingers movable radially with respect to the axis of the collet and with respect to a casing to be re-sized so that during closing there is no substantial component of circumferential motion between any part of the respective collet fingers and a casing on which the collet fingers are being closed, said collet being mounted under said work table in position to surround a casing tubular portion and flange which is carried by said supporting member when it is below said work table, the inner surface of said collet being shaped to resize the flange and tubular portion of said casing when said collet is contracted, and means for contracting said collet to resize said flange and tubular portion and then expanding said collet to permit said casing to be removed therefrom.

2. The resizer as in claim 1 wherein said collet has a plurality of circumferentially spaced segments that are contractible by applying inward pressure thereto and expandable by releasing the inward pressure to permit the segments to return to their original spaced positions.

3. The resizer as in claim 2 wherein said means for radially contracting and expanding said collet comprises a collet sleeve mounted below said collet segments and means for forcing said sleeve over the exterior of said collet segments to cause said segments to contract and for forcing said sleeve away from said collet segments to permit them to return to their original spaced positions.

4. The resizer as in claim 3 further comprising an actuation lever on said frame, and wherein said means for forcing said collet sleeve over said collet segments comprises a slide on said frame, means on said slide for engaging a portion of said actuation lever to be moved thereby, a rocker arm pivotally attached to said frame and to said slide, and a toggle linkage connected between said rocker arm and said collet sleeve.

5. The resizer as in claim 1 wherein said collet is hollow and wherein said casing supporting member is mounted within said collet.

6. The resizer as in claim 5 and further comprising an actuation lever on said frame, and means linking said casing supporting member to said actuation lever for raising and lowering said casing supporting member in response to movement of said actuation lever.

7. The resizer as in claim 1 also comprising a plurality of reloading tools movably mounted on said frame above said work table, said reloading tools including a primer punch, and wherein said casing supporting member and resizing collet are located below said primer punch.

8. The resizer as in claim 7 wherein said reloading tools are mounted on a tool carriage, and further comprising a rod attached at one end to said tool carriage and slideably attached to said work table and extending therebelow, means for lowering said tool carriage to bring said reloading tools into operative relationship with casings on said work table and for raising said tool carriage to lift said reloading tools above said casings, and means coupling the end of said rod below said work table to said casing supporting member to raise and lower the latter.

9. The resizer as in claim 5 wherein said casing supporting member has a flange on its upper end and further comprising a lip on the inner portion of said collet for supporting said flange in the lowermost position of said shell supporting member.

10. The resizer as in claim 1 wherein said resizing collet includes a hollow cylinder, there being threads on one end of said cylinder for attaching said cylinder to said frame.

11. In a cartridge casing resizer comprising a frame, the improvement comprising a radially expandable and contractible resizing collet having a sufficiently large number of gripping fingers movable radially with respect to the axis of the collet and with respect to a casing to be re-sized so that during closing there is no substantial component of circumferential motion between any part of the respective collet fingers and a casing on which the collet fingers are being closed said collet being mounted on said frame, said collet being dimensioned to receive the flange and tubular portion of a casing in its expanded condition and to resize said flange and tubular portion when contracted, and means for contracting said collet to resize said flange and tubular portion and then expanding said collet to permit the resized casing to be removed from said collet.

12. The resizer as in claim 11 wherein said gripping fingers comprise a plurality of circumferentially spaced segments which can be radially contracted by applying inward pressure thereto and can be radially expanded by releasing the inward pressure to permit the segments to return to their original spaced positions, and wherein said means for radially expanding and contracting said collet comprises a collet sleeve mounted below said collet segments and means for forcing said sleeve upwardly over the exterior of said collet segments to cause said segments to contract and for forcing said sleeve downwardly away from said collet segments to permit them to return to their original spaced positions.

13. The resizer as in claim 12 further comprising an actuation arm pivotally mounted on said frame, and wherein said means for forcing said collet sleeve over said collet segments comprises a rocker arm pivotally mounted on said frame below said sleeve, a toggle linkage connected between said rocker arm and collet sleeve, and means connected between said rocker arm and actuation arm for rocking said rocker arm in response to movements of said actuation arm to raise and lower said collet sleeve.

14. The resizer as in claim 12 also comprising a casing supporting member slideably mounted within said collet and means for lowering said supporting member to lower the flange and tubular portion of a casing thereon within said collet to be resized and for raising said supporting member to lift the resized casing out of said collet.

15. The resizer as in claim 14 and also including an actuation arm pivotally mounted on said frame, means coupling said actuation arm to said collet sleeve to raise and lower the sleeve in response to movements of said actuation arm, and means coupling said actuation arm to said casing supporting member to raise and lower the latter in response to movements of said actuation arm.

16. The resizer of claim 14 wherein said casing supporting member is hollow and further comprising a cross-bore therein to permit foreign material to pass from the exterior of said casing supporting member to the interior thereof.

17. A resizer for the flange and tubular portion of a cartridge casing comprising a frame, a work table mounted on said frame, means on said work table for receiving the flanged end of a plurality of casings and for moving said casings to a plurality of work stations on said work table, a casing supporting member mounted under one work station of said work table, means for producing relative motion between said casing supporting member and said work table to move said casing supporting member from a position level with the top of said table to a position below said table, a resizing collet mounted under said work table in position to surround a casing tubular portion and flange which is carried by said supporting member when it is below said work table, said collet including a plurality of circumferentially spaced segments which can be radially contracted by applying inward pressure thereto and can be radially expanded by releasing the inward pressure to permit the segments to return to their original spaced positions, the inner surface of said segments being shaped to resize the flange and tubular portion of said casing when said segments are contracted, a collet sleeve mounted below said collet segments, an actuation lever on said frame, a slide on said frame, means on said slide for engaging a portion of said actuation lever to be moved thereby, a rocker arm pivotally attached to said frame and to said slide, and a toggle linkage connected between said rocker arm and said collet sleeve for forcing said collet sleeve over said collet segments.

18. A resizer for the flange and tubular portion of a cartridge casing comprising: a frame, a work table mounted on said frame, means on said work table for receiving the flanged end of a plurality of casings and for moving said casings to a plurality of work stations on said work table, a casing supporting member mounted under one work station of said table, means for producing relative motion between said casing supporting member and said work table to move said casing supporting member from a position level with the top of said table to a position below said table, a radially expandable and contractible resizing collet having a sufficiently large number of gripping fingers movable radially with respect to the axis of the collet and with respect to a casing to be re-sized so that during closing there is no substantial component of circumferential motion between any part of the respective collet fingers and a casing on which the collet fingers are being closed, said collet being mounted under said work table in a position to surround a casing tubular portion and flange which is carried by said supporting member when it is below said work table, the inner surface of said collet being shaped to resize the flange and tubular portion of said casing when said collet is contracted, means for contracting said collet to resize said flange and tubular portion and for then expanding said collet to permit removal of said casing therefrom, a tool carriage movably mounted above said work table and a plurality of reloading tools including a primer punch mounted on said carriage, said casing supporting member and collet being located below said primer punch, a rod attached at one end to said tool carriage and slideably attached to said work table and extending below it, means for lowering said tool carriage to bring said reloading tools into operative relationship with casings on said work table and for raising said tool carriage to lift said tools above said casings, and means coupling the end of said rod below said work table to said casing supporting member to raise and lower it.

19. A resizer for the flange and tubular portion of a cartridge casing comprising a frame, a radially expandable and contractible resizing collet mounted on said frame, said collet being dimensioned to receive the flange and tubular portion of a casing in its expanded condition and to resize said flange and tubular portion when contracted, said collet having a plurality of circumferentially spaced segments which can be radially contracted by applying inward pressure thereto and can be radially expanded by releasing the inward pressure to permit the segments to return to their original spaced positions, means for radially expanding and contracting said collet comprising a collet sleeve mounted below said collet segments, a rocker arm pivotally mounted on said frame below said sleeve, a toggle linkage connected between said rocker arm and collet sleeve, an actuation arm pivotally mounted on said frame, and means connected between said rocker arm and actuation arm for rocking said rocker arm in response to movements of said actuation arm to raise and lower said collet sleeve, said sleeve when raised contracting said collet to thereby resize said flange and tubular portion, said sleeve when lowered allowing expansion of said collet to permit the resized casing to be removed from said collet.

20. The resizer of claim 19 also comprising a casing supporting member slideably mounted within said collet and means for lowering said supporting member to lower the casing thereon within said collet to be resized and for raising said supporting member to lift the resized casing out of said collet.

21. The resizer of claim 20 wherein said casing supporting member is hollow and further comprising a cross-bore therein to permit foreign material to pass from the exterior of said casing supporting member to the interior thereof.

22. A resizer for the flange and tubular portion of a cartridge casing comprising: base means, collet means including a plurality of circumferentially spaced segments which can be radially contracted by applying inward pressure thereto and can be radially expanded by releasing the inward pressure to permit said segments to return to their spaced positions, the inner surfaces of said segments being shaped to resize the flange and tubular portion of said casing, said segments being fixedly mounted relative to said base, a body supported for movement in opposed directions, means for moving said body, a collet sleeve mounted in said body for moving therewith substantially coaxially to said circumferentially spaced segments between positions wherein said sleeve is retracted from said segments and alternately wherein said sleeve is advanced to apply a substantial inward pressure to said segments to contract them and effect resizing of a casing disposed within them.

23. The resizer as in claim 22 wherein said segments have a shoulder inwardly thereof and a groove spaced from said shoulder for receiving a casing flange, said shoulders being radially expanded from each other by a sufficient amount for the said flange to be received thereon and supported thereby when said sleeve is retracted, an elongated movable casing supporting member extending substantially coaxially into the space between said segments and including head means engageable by said shoulders, stop means for establishing limits to the movement of said supporting member, said head means of said casing supporting means being positioned for supporting a casing when said sleeve is retracted, movement of said sleeve for contracting said segments causing said shoulders to engage and support said head means and to dispose said flange in said groove and said tubular portion between said jaws for resizing.

24. A cartridge casing reloader including a resizer for the flange and tubular portion of a cartridge casing comprising: a base, a body, means on said base to support said body for linear movement in opposed axial directions, collet means including a plurality of generally axially disposed stationary circumferentially separable segments which can be radially contracted by applying inward pressure to them and can be radially expanded by releasing said pressure to allow said segments to return to their original expanded positions, the radially inward surfaces of said segments being shaped for resizing the flange and tubular portion of a casing when said segments are contracted, sleeve means mounted on said body means coaxially with said segments for being advanced with said body to contract said segments and for being retracted with said body to allow said segments to expand, a work table on said body and means on said work table for receiving the flanged ends of a plurality of casings and for moving said casings to a plurality of work stations, a casing supporting member mounted for axial movement within said segments in line with one of said work stations, stop means for maintaining said casing supporting member in a position for supporting a casing on said work table when said body and sleeve are retracted, advancing said body and sleeve causing said segments to progressively advance along said casing and contract to effect resizing of said casing.

25. The reloader as in claim 24 wherein each of said segments have inner shoulder means and groove means adjacent thereto for receiving and resizing said flange of a casing, head means on said casing supporting member engageble by said shoulder means are being contracted by advancement of said sleeve means, said head means reacting against said shoulder means and the end of said casing when its flange is in said grooves and said segments are fully contracted to thereby reshape the end of said casing.

26. The reloader as in claim 25 including means for stopping movement of said supporting member and thereby holding said head means against said shoulder means prior to said sleeve means being fully advanced.

27. The reloader as in claim 25 including a shaft journaled on said base with its axis perpendicular to the line of movement by said body, a manual operating arm extending radially from said shaft, a pair of toggle mechanisms including a lever fixed to and extending radially from said shaft and a link pivotally connected to said lever and said body, swinging said arm in opposed directions advancing and retracting said body by the action of said toggle mechanism.

28. A resizer for the flange and tubular part of a cartridge casing comprising: collet means including a plurality of generally axially directed circumferentially arranged separable segments which are radially expandable and contractible, said segments having axially extending portions which are shaped for cooperatively resizing said tubular part of said casing when said casing is within said segments and said segments are contracted, each segment having a groove for the flange of a casing to be admitted for resizing in each of said axially extending portions, said grooves being defined by at least one surface that is complementary to the desired shape and size of said casing flange, a shoulder on said segments adjacent said respective grooves, a sleeve coaxial with said segments said sleeve and said segments being advanceable relative to each other for said sleeve and segments to interact for developing a radially inward force to contract said segments and being retractable to release said segments for expansion, a casing supporting member extending within said segments and having shoulder means for being supported by the aforesaid shoulder means of said segments when said segments are being contracted whereby engagement of said surface of said groove with a casing flange during contraction will force the end of said casing against said support and reshape said end.

29. The resizer as in claim 28 wherein said one surface of said groove is beveled and at an angle and another surface of said groove is axially spaced therefrom toward the shoulder on its segment and is more nearly coplanar with a surface to which the axis of said collet means is perpendicular, a head on said casing supporting member providing said shoulder means, said head extending axially of said other surface of said groove to displace one side of said casing flange from said other surface to allow said flange to be pressed toward said other surface to thereby resize and reshape the end of said casing.

* * * * *